US005116278A

United States Patent [19]

Sroub et al.

[11] Patent Number: 5,116,278

[45] Date of Patent: May 26, 1992

[54] BRASSIERE FOR WOMEN

[75] Inventors: Brian J. Sroub, 3123 Portsmouth Ave., Cincinnati, Ohio 45208; Melvin A. Pomeranz, Marina del Rey, Calif.

[73] Assignee: Brian J. Sroub, Shaker Heights, Ohio

[21] Appl. No.: 637,020

[22] Filed: Jan. 3, 1991

[51] Int. Cl.[5] ..... A41C 3/14

[52] U.S. Cl. ..... 450/61; 450/60; 450/65; 450/66; 450/67; 450/70; 450/76; 2/67; 2/73

[58] Field of Search ..... 2/67, 73; 450/60, 61, 450/62, 65, 66, 67, 70, 74, 75, 76

[56] References Cited

U.S. PATENT DOCUMENTS

| | | | |
|---|---|---|---|
| 1,290,608 | 1/1919 | Lowman | 450/1 |
| 1,994,359 | 3/1935 | Greenbaum | 450/76 |
| 2,088,950 | 8/1937 | Née Le Compte | 450/1 |
| 2,132,128 | 10/1938 | Rasch | 450/65 |
| 2,560,706 | 7/1951 | Spetalnik | 450/65 |
| 2,940,454 | 6/1960 | Faron | 450/67 |
| 3,220,415 | 11/1965 | Manno | 450/65 |
| 3,338,242 | 8/1967 | Gemreich | 450/70 |
| 3,709,230 | 1/1973 | Rich | 450/62 |
| 3,908,670 | 9/1975 | Dubin | 450/66 |
| 4,538,614 | 9/1985 | Henderson | 450/70 |

FOREIGN PATENT DOCUMENTS

| | | | |
|---|---|---|---|
| 0174590 | 1/1952 | Fed. Rep. of Germany | 450/75 |
| 0859322 | 12/1940 | France | 450/70 |
| 1178092 | 5/1959 | France | 450/60 |

*Primary Examiner*—Werner H. Schroeder
*Assistant Examiner*—Jeanette E. Chapman
*Attorney, Agent, or Firm*—Donald D. Mon

[57] ABSTRACT

A woman's brassiere individual sizes of which can accommodate a substantial range of rib cage and cup sizes. A pair of cups, with an elastic web is joined to an encircling band A shoulder loop is attached to each cup and to the encircling band. Elastic risers bind the sides of each cup and extend from the band to respective shoulder straps. An elastic cradle has a lower edge anchored to the band, and an upper free edge entirely unattached to the web of the cup so it can move in relative shear-like movement relative to the web. The cradle reinforces the web when the web is substantially deflected by a breast, and supports the lower portion of the breast independently of the web.

10 Claims, 2 Drawing Sheets

BRASSIERE FOR WOMEN

FIELD OF THE INVENTION

This invention relates to women's brassieres.

BACKGROUND OF THE INVENTION

The range of variations of shape and size of women's breasts, and also of the rib cage sizes and configurations are very large. As a consequence, in order to provide a reasonably good fit and support without resort to custom fitting, manufacturers have had to make available a large number of individual sizes. These sizes are generally related to the dimension of girth (rib cage size) and of the size of the breasts. Examples are sizes 36A, 36B and 36C. Of course there are many other rib cage and cup sizes, and each style of brassiere is expected to be stocked a in very wide range. This is a burden not only on the manufacturer, but also on the distributors and retailers who must maintain them all in inventory.

It is an object of this invention to provide a brassiere construction which in only three items can provide good fit and support for as many as 35 combinations of rib cage and cup sizes, for example from rib cage sizes 32–40 and accompanying cup sizes from A–D. This results in a sharp reduction of inventory and greatly simplifies the task of the retailer. These three sizes attend to most of the brassiere market.

Of course the customer is unconcerned with the retailer's problems. Her concern is that there be adequate coverage and support for her breasts provided by an attractive garment. The unique construction of the brassiere of this invention does provide these functions remarkably well, especially considering the fact that some of them will be used to accommodate three or even four cup sizes for the same rib cage size.

It is yet another object of this invention to provide a breast support in which an individual brassiere can provide increased support as the breast size accommodated increases while also providing full suitable coverage of both the larger and the smaller breasts within its intended range of fit.

BRIEF DESCRIPTION OF THE INVENTION

A brassiere according to this invention includes a pair of breast cups joined to an encircling band. Each cup has a central web bounded by its attachment to the encircling band and by two risers which extend from the band, converging toward one another as they rise, and terminating at a shoulder strap. The strap forms a loop which is also attached to the encircling band.

The brassiere further includes a cradle underlying a portion of the web nearest to the encircling band. It is attached to the web at its lower end and to its adjacent risers, but is otherwise free from the web. The cradle is anchored to the band to restrain its upward movement as will be described in detail below.

The function of the web is to give full coverage to the breast, over a wide range of cup sizes. For larger-sized breasts it may also provide some side support as well as some resistance to excess bounce.

The function of the cradle is to give primary upward support to the breast, again over a wide range of cup sizes. Being mounted to the risers and to the lower margin of the band but being otherwise free of the web, it can respond to breast sizes and movements differently than the web does, enabling a single brassiere to provide both full coverage and suitable support for the intended wide range of sizes.

According to the invention, the materials of the web, of the risers, and of the cradle have individual, and frequently different physical properties of extension and response to tension. These terms and the consequences of these properties are fully discussed below.

The above and other features of this invention will be fully understood from the following detailed description and the accompanying drawings, in which:

DETAILED DESCRIPTION OF THE INVENTION

Figure 1:
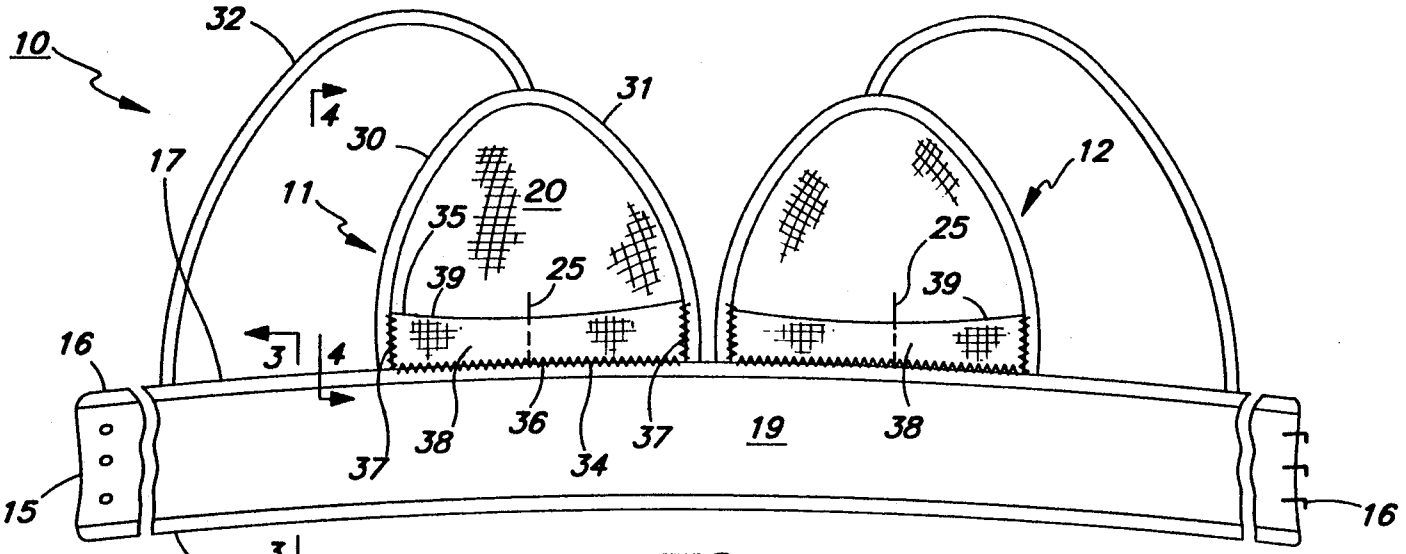
FIG. 1 is a front view of one embodiment of the invention.

FIG. 1 shows a brassiere 10 according to this invention. It is provided with two interconnected cup parts 11, 12. Because these are mirror images of one another, only cup 11 will be described in detail.

The brassiere includes an encircling band 15 intended to be fastened around the rib cage of the wearer. At each end it has fastener means 16, such as conventional hooks and eyes to facilitate putting on and taking off the brassiere. Instead, the band at the rear could be continuous, and the band divided in front, between the cups with the hooks and eyes provided in front (not shown). This creates a front-opening bra whose properties are otherwise the same. The band is elastic, with its principal elastic properties provided by strips 17, 18. Strips 17 and 18 are joined by a flexible elastic filler strip 19 which is provided principally to join strips 17 and 18 together, and to fill in the space between them. In fact, only strip 17 is necessary in order to provide support for the cups, but in practice a broader band will be more comfortable, and much better looking.

Cup 11 includes a web 20 intended to cover the breast to the extent desired, and to give the individual breast some upward, inward, and sidewise (squeeze) support. However, this is not the primary purpose of the web.

Web 20 is usually formed from a single piece of material. To provide shape, a dart 25 may be sewn into it, rising from the bottom of the web. This provides for better conformation with the breast. Of course it could instead be made of a plurality of stitched-together pieces, or made in a molded single piece, as preferred.

Elastic risers 30,31 are stitched to the side edges of the web. They converge toward one another, and meet where they join to a shoulder loop 32. The loop is connected at its other end to the encircling band, and usually includes an adjustment means (not shown).

A cradle 35 underlays the lower portion of the web. The cradle and the web are joined to one another at the lower edge 34 of the cradle by a stretch stitch 36. It is convenient for stitch 36 also to join the web and the cradle to band 15, which serves to "anchor" the lower edge of the cradle to the band. In order to eliminate or at least reduce bulkiness along the band, it may be preferred instead to permit the web material to extend downwardly a short distance below stitch 36, and then to stitch the web material only to the elastic band. This arrangement will still serve to anchor the cradle to the band, because the amount of extension of the web material will be quite small. For example, when about ⅜ inch of free web material remains between stitch 36 and whatever stitch joins it to the band exterior of about the same amount which would result only from a rather larger force it, would not adversely affect the functioning of the brassiere. Therefore, the term "anchoring" as used herein means that at least the central portion of the junction of the web and of the cradle's bottom edge is immediately or closely connected to the band. When it is sewn to the band, the connection is immediate and direct. When some web material intervenes, it is connected, or anchored to the band by that material.

Figure 2:
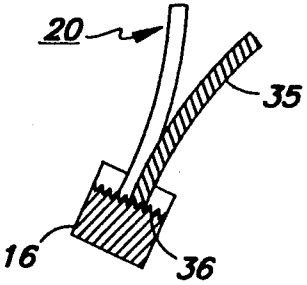
FIG. 2 is a fragmentary cross-section taken at line 2—2 in FIG. 1.
Figure 3:
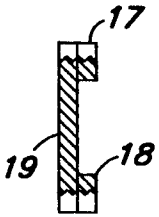
FIG. 3 is a cross-section taken at line 3—3 in FIG. 1.
Figure 4:
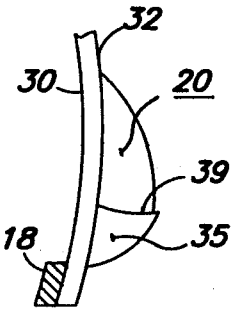
FIG. 4 is a side view, partly in cross-section, taken at line 4—4 in FIG. 1.

Stretch stitches 37 join the left and right hand edges of the webs to the risers. These stitches also join the left and right hand edges 40,41 of the cradle to the risers. The central area 38 and the free edge 39 of the cradle are free from the web. As best shown in FIG. 2, the web and the cradle are free from one another except at the stitches so they can slide along one another in a shear-like movement without substantial impediment.

The term "web" as used herein means only the fabric which forms the sheet (or form) of material bounded by the risers and by the engagement with the cradle's lower edge. It does not include the cradle itself.

Figure 5:
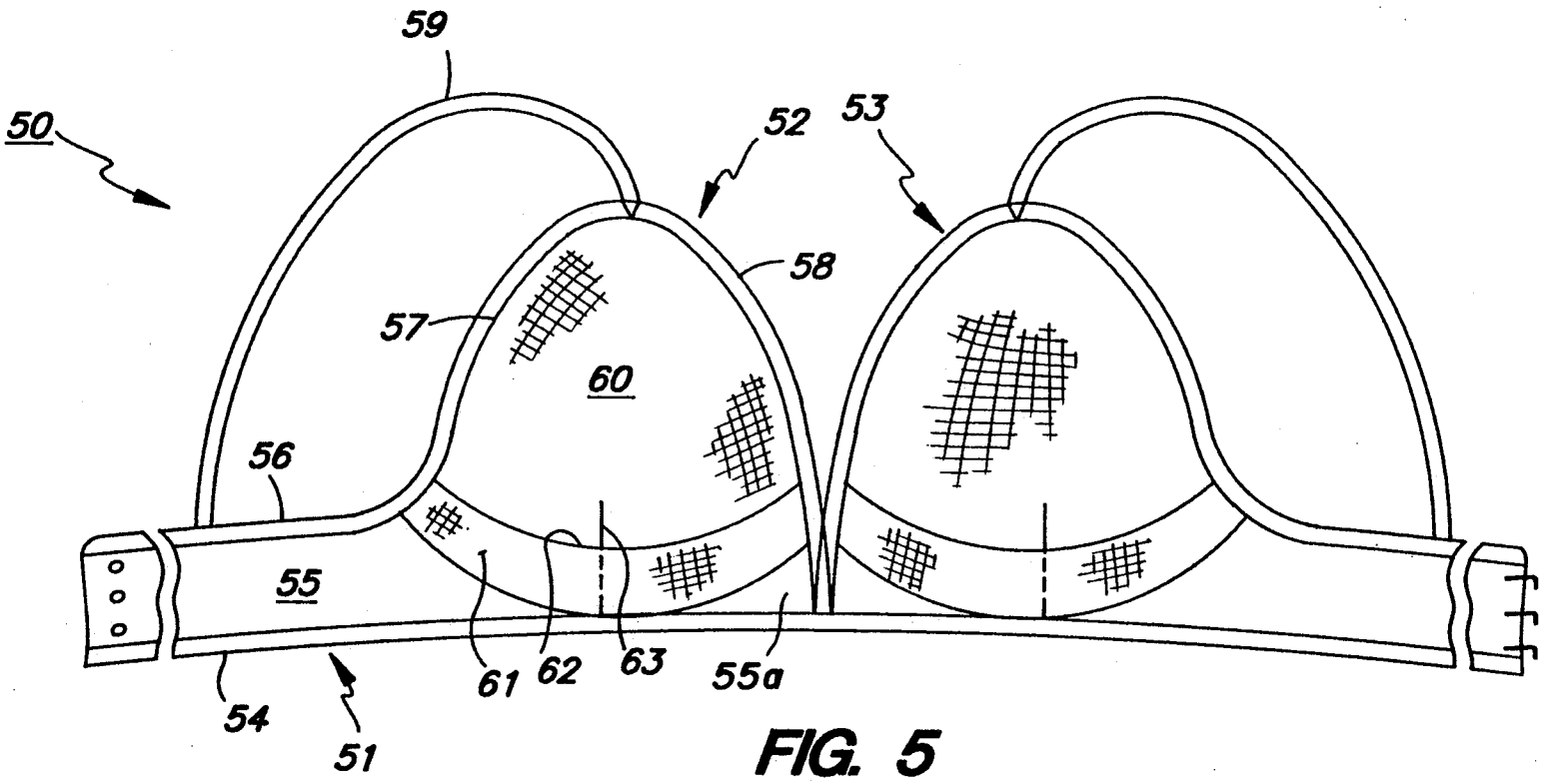
FIG. 5 is a front view of the presently-preferred embodiment of the invention.

A somewhat different construction is shown in FIG. 5, although the structural features important to this invention are essentially the same as in the embodiment of FIG. 1. FIG. 5 shows a brassiere 50 to having an encircling band 51. It includes a pair of cups 52,53. These cups are mirror images of one another, and are similarly constructed. Accordingly only cup 52 and its associated structure and components will be described in detail.

An elastic strap 54 forms the lower boundary of the encircling band 51, and is the primary member for circularly embracing the torso. A filler 55, which may and usually will be a continuation of the web material, is stitched to it, and rises to an upper course 56 of an elastic strap which continues as riser 57. A second riser 58 joins elastic strap 54 at the front center of the brassiere.

A second filler **55*a***, which also will usually be a continuation of the web material, is stitched in between the cradle and the strap.

As in FIG. 1, the risers converge toward one another, and meet at an end of a shoulder loop 59. The other end of the shoulder loop joins to upper course 56. Length adjustment means (not shown) can be provided.

The central two of the risers of each cup are joined to each other and to the encircling band at the front center point. They taper away from each other as they approach their respective shoulder straps.

A web 60 is stitched to the risers and to the encircling band. A cradle 61 is stitched only to the web and to the risers. It underlays the web as in FIG. 1, and is free from it except at its side and bottom edges. Its free edge 62 is its uppermost boundary. A dart 63 may be sewn into the web if desired or it may be preformed.

In the embodiment of FIG. 5, the cradle is "anchored" to the encircling band as already described. In this embodiment, the anchorage is not for its length. Instead it is only near the center, and then perhaps at a short distance from it, as described above. The stretch of the filler material to each side is not sufficient to frustrate the benefits of the bra.

Brassieres according to this invention derive their advantages from the physical properties of their various components, and from the way they are assembled. In order rigorously to describe these properties, the following terms will be used with the following expressed intended meanings.

Extension will be used to describe the length to which a material can be stretched without permanent deformation. High extension describes a material which can be stretched for a long distance without substantial permanently deforming the material. Similarly, low extension describes a material which can be stretched for only a short distance without deforming the material permanently. Extension is measured as a percentage (%) of the initial at rest length of the material according to the following formula:

$$\frac{(Lf - Lo)}{Lo} \times 100 = \text{Percent Extension}$$

where Lf is the final stretched length and Lo is the initial unstretched length. For example, a one inch long sample which is stretched to a total length of 2 inches has experienced an extension of 100%.

Maximum extension is the largest extension which the material in question can undergo without incurring significant permanent deformation upon release of the stretching force.

Tension will be used to describe the force per unit width of material which is needed to maintain the material in an extended state. The tension can thus be thought of as the restraining force which is exerted on the woman's body by the material of the present invention. Since most of the material will generally exhibit behavior whereby the tension increases with the increased extension, the tension at 150% extension will be used for comparison of the various materials.

A conventional brassiere customarily provides a cloth cup surrounded by supporting structure. The supporting structure generally includes a suspension system to hold the cloth cup to the breast, including shoulder straps and an encircling band. The encircling band is provided by rib cage size, and the cup is provided by breast cup size. This is why so many sizes of conventional brassieres are required to be made by the manufacturer and to be stocked by the retailer. By means of this invention, which utilizes previously unsuggested combinations of materials, one individual brassiere is enabled to fit a large range of chest and bust sizes.

The material of the web is intended to be "spreadable". By this is meant that its extendibility is to be substantial enough that it can spread over and cover a large array of cup sizes. In its rest position, it will nicely cover a smaller breast cup size. To be practical, it must be spreadable to cover still larger sizes, and even accommodate this range of sizes on larger rib cage sizes. The material of the web is not primarily meant for support of the breast. For smaller cup sizes it will give even lesser support. However, as the cup size accommodated increases, the tension exerted by the physical reaction between the tissue and the cup results in a supporting force derived from the extension. Thus this material provides "some" upward and sideward ("squeeze" support). Although this is not its primary objective, it does provide to the larger busted woman with some restraint against bounce, while still providing full coverage.

The material of the cradle is intended for a different purpose. It underlays the web, and extends upward beneath the outside of the web for between about $\frac{2}{3}$ to $\frac{3}{4}$ of the distance to the location anticipated for the nipple. Except at its right and left hand edges, and at its bottom edge, it is completely free of the web. It should form a "net" fit (i.e. a continuous fit against the web) when the brassiere is fitted onto the smallest intended breast in the respective size range. This avoids puckering. For the very smallest breast, the web will distend just to meet the cradle, and while it provides only "some" support in addition to coverage, it often will be sufficient.

As the breast size increases, more support is needed, and the web is not intended for this purpose, even though it does indeed provide some support although minimal. Instead the cradle is provided for the support. As stated, the web and the cradle are slidably movable relative to one another in a shear sense. The combination of the web and the cradle material does not constitute the equivalent of a bonded-together construction. That class of reaction is not intended. Instead, the web and the cradle each performs its function independently of the other.

As the larger breasts are accommodated, they tend to sag, and the web provides no substantial support. This is the function of the cradle. Its "tension" is higher than that of the web material, and preferably although not necessarily, it is higher in the vertically oriented direction in the brassiere than in the horizontal. Thus, as the weight on the cradle increases, its support increases. It does not interfere with the web, nor does the web interfere with it.

For the risers and for the encircling bands, the properties of the material are such as to expand and retract comfortably within the size range, while still holding the triangular pattern which outlines the cups against the chest. Conventional materials are suitable for this element.

The following table illustrates the preferred properties of the various materials. The x dimension means essentially horizontal when worn by a woman and the y dimension means more vertical.

| | | Maximum Extension | | Tension @ Maximum Extension | |
|---|---|---|---|---|---|
| | | Broad | Preferred | Broad | Preferred |
| Web: | x | >200% | >300% | <400 g/in. | <250 g/in. |
| | y | 0 | >20% | <400 g/in. | <250 g/in. |
| Cradle: | x | <200% | <150% | >250 g/in. | >400 g/in. |
| | y | not relevant to the invention | | | |
| Risers: | x | <150% | <100% | >400 g/in. | >600 g/in. |
| | y | none or very little | | | |
| Traditional knits | | | <50% | <400 g/in at 50% | |
| Trad'l knits w/ lycra | | | <100% | <600 g/in. at 100% | |
| Rubber/latex | | | >300% | >800 g/in. | |

The inclusion of traditional knits, traditional knits with Lycra, and rubber/latex are intended as comparative examples, to illustrate the difference of the material, of the cup and of the cradle from conventional brassiere materials.

There are some materials which provide for greater extendibility in one direction than in another, and advantage of this can be taken, especially for the web. For the web, a larger horizontal extendibility than vertical can be useful to give at least some support, and to provide for good coverage. A fabric useful for this purpose is sold by Liberty Fabrics, 2 Park Avenue, New York, N.Y. 10016, as Cloth 2066, or 2071, whose important properties are defined above.

As to the cradle, any suitably extensible, usually fibrous material with elasticity which is equal or different in the two directions is suitable. Typical elastic materials regularly used in brassieres are suitable.

The elastic properties of the risers and of the encircling band are well-known in the art, as well as suitable selections for them.

This invention thereby provides a brassiere, one item of which is useful over a wide range of sizes, which provides good coverage and good support for the women's breasts.

This invention is not to be limited by the embodiments shown in the drawings and described in the description, which are given by way of example and not of limitation, but only in accordance with the scope of the appended claims.

We claim:

1. In a woman's brassieres comprising an encircling band adapted to be fastened around her rib cage, a pair of cups joined to the encircling band, and a pair of shoulder loops each attached to a respective cup and to the encircling band, the improvement comprising;

said cups being bounded on their sides by a pair of elastic risers joined to the encircling band and to an end of a respective shoulder strap, said risers converging toward the shoulder strap, said cups comprising a web of elastic material with side edges continuously joined to said risers and anchored to said band; and a cradle comprising an elastic member having a lower edge anchored to the encircling band, and an upper free edge entirely unattached to said web, whereby its surface between said side edges and above a lower edge are entirely unattached to said web and free to move in relative shear-like movement, said cradle also having side edges, said side edges being joined to respective risers, whereby said cradle acts to reinforce said web when said web is substantially deflected by a breast and to support the lower portion of said breast independently of said web.

2. A brassiere according to claim 1 in which said encircling band includes a pair of elastic members joined to and spaced apart by an elastic filler member, whereby to provide a wider band.

3. A brassiere according to claim 1 in which said encircling band comprises an elastic member to encircle the rib cage, an elastic filler member attached to it, and an upper elastic member attached to the filler member and continuing as a riser to its respective shoulder loop.

4. A brassiere according to claim 1 in which the central risers of each cup are attached to one another adjacent to said encircling band adjacent to one another.

5. A brassiere according to claim 1 in which the material of said web has substantial extendibility in both horizontal and vertical directions, sufficient to extend to cover the woman's breast in a plurality of sizes.

6. A brassiere according to claim 5 in which the tension of said web is greater in the vertical than in the horizontal direction.

7. A brassiere according to claim 5 in which the material of the cradle has a lesser maximum extension and a greater tension than the material of the web.

8. A brassiere according to claim 7 in which the tension of said web is greater in the vertical than in the horizontal direction.

9. A woman's brassiere comprising:

a support structure comprising an elastic encircling band, two pairs of elastic risers attached to said band and tapering toward one another, a pair of shoulder loops extending from the risers to the encircling band, said support structure forming the boundary of a pair of cups;

each cup comprising a central web, said web being continuously attached to its respective risers, and anchored to said band, and a cradle having a lower edge continuously stitched to said web and anchored to said band, two side edges continuously stitched to respective risers, an upper free edge extending between risers and a central area, said free edge and said central area being unattached to said web and free from it;

the material of said web having substantial extension in both horizontal and vertical directions, sufficient to cover the woman's breast in a plurality of sizes.

10. A brassiere according to claim 9 in which the material of the cradle has a lesser maximum extension and a greater tension than the material of the web.

* * * * *